US005819988A

United States Patent [19]

Sawhney et al.

[11] Patent Number: 5,819,988

[45] Date of Patent: Oct. 13, 1998

[54] DOUBLE-BARRELED SYRINGE WITH DETACHABLE LOCKING MIXING TIP

[76] Inventors: Ravi K. Sawhney, 3501 Via Del Prado, Calabasas, Calif. 91302; Lance Hussey, 4151 Saugus Ave., Sherman Oaks, Calif. 91403

[21] Appl. No.: 829,944

[22] Filed: Apr. 1, 1997

[51] Int. Cl.[6] ..... B67D 5/52

[52] U.S. Cl. ..... 222/137; 222/145.6; 222/153.09; 222/459; 239/399

[58] Field of Search ..... 222/137, 145.6, 222/153.09, 386, 459; 239/399

[56] References Cited

U.S. PATENT DOCUMENTS 3,166,221 1/1965 Nielsen ..... 222/137
3,330,444 7/1967 Raypholtz ..... 222/145.6
4,974,756 12/1990 Pearson et al. ..... 222/145.6
5,413,253 5/1995 Simmen ..... 222/137
5,609,271 3/1997 Keller et al. ..... 222/145.6

*Primary Examiner*—Joseph Kaufman
*Attorney, Agent, or Firm*—Donald Diamond

[57] ABSTRACT

A double-barreled syringe is provided which includes a mixing tip which is detachable after the tip is locked to the syringe body, so that the tip may be replaced by a locking cap. Locking occurs when a neck extending from the body between two shoulders is inserted into a bore in the tip (or, alternatively, the cap) and the tip is rotated so that two symmetrically opposed tabs attached to the tip are each received within a recess determined by a shoulder and a locking rib attached to the shoulder, and two diametrically opposed detents extending from the neck are each received within a recess in the bore surface.

4 Claims, 3 Drawing Sheets

DOUBLE-BARRELED SYRINGE WITH DETACHABLE LOCKING MIXING TIP

BACKGROUND OF THE INVENTION

1. Field of the Invention

The present invention relates to multiple-barreled devices for mixing together and dispensing viscous substances. More particularly, the invention relates to a double-barreled syringe for dispensing an admixture formed when two gels stored in the barrels are simultaneously discharged into a mixing tip having a static mixing element. The tip, which interlocks with the syringe body, is detachable and may be replaced by a locking closure cap to prevent leakage when the syringe is not in use.

2. Description of the Related Art

Devices for mixing and dispensing a viscous fluid having separately stored constituents wherein a mixing portion is detachably connected to a storage portion are known in the art. U.S. Pat. No. 5,413,253 to C. Simmen discloses a static mixer for connection to a cartridge having at least two chambers containing different materials. The mixer is connected to the cartridge by inserting hollow circular male prongs and arcuate positioning keys of a center plug within corresponding female outlets in the cartridge. The plug is rotatably mounted within the collar of a sleeve. The mixer is locked to the cartridge by rotating the collar until opposed tabs on the sleeve engage with locking arms on the dispensing end of the cartridge.

U.S. Pat. No. 4,538,920 to G. E. Drake discloses a double-barreled syringe for mixing and dispensing a two-component material such as a resin and its hardener. Both a mixing tip and a static mixing element located within the tip bore are fixably rotationally aligned with the syringe body so that the first blade of the mixing element is generally perpendicular to the plane of contiguity between the two component streams exiting a syringe body outlet. The mixing tip is connected to the body by centering the tip inlet over the body outlet while aligning the tip so that it can be pushed between opposed bayonet locking tabs, each having a prong and a stop surface, and then rotating the tip so that opposed ramps on the tip inlet end are wedged between the prongs, and a stop surface proximate to each ramp engages a tab stop surface.

Although either of these devices enables the storage and mixing portions to be connected and then detached multiple times, both are so complex as to be unsuitable for mass production of inexpensive, throwaway dispensers. What is needed is a device which on demand can thoroughly mix two-component viscous materials and dispense a desired amount of the admixture, which will not leak when set aside, and which can be mass produced at relatively little cost.

OBJECTS OF THE INVENTION

Accordingly, it is an object of the present invention to provide a simple, reliable and convenient device which simultaneously dispenses equal amounts of two viscous materials as an admixture.

Another object of the invention is to provide a device which can be repetitively used to dispense desired amounts of an admixture.

A further object of the invention is to provide a device having a storage portion and a mixing-dispensing portion which repetitively can be easily connected and then detached.

A still further object of the invention is to provide a device that is inexpensive to manufacture.

Other objects of the invention will become evident when the following description is considered with the accompanying drawing figures. In the figures and description, numerals indicate the various features of the invention, like numerals referring to like features throughout both the drawings and the description.

SUMMARY OF THE INVENTION

These and other objects are achieved by the present invention which provides a double-barreled syringe wherein one barrel contains a hydrogen peroxide water-based gel formulation used for teeth whitening, and the other contains a gel formulation including compounds that will accelerate the release of oxygen from the first formulation and consequently increase the reaction rate of the teeth whitening process. The syringe dispenses an admixture formed when the two formulations are simultaneously discharged into a mixing tip having a static mixing element. The tip, which is in locking connection with the syringe body, is replaced by a locking closure cap to prevent leakage when the syringe is not in use.

The syringe body includes a double-barrel assembly having juxtaposed first and second barrels having a common length and a generally cylindrical bore of a common diameter. Each barrel is bounded at a discharge end by first and second shoulders, respectively, with each shoulder having a generally planar surface. The surfaces are coplanar and contiguous. A generally cylindrical neck extends from and is symmetrically disposed between the shoulders. The neck includes first and second outlet passages. Each barrel at its opposite (plunger) end closely receives a piston within its bore. An arcuately-shaped finger-grip circumscribes the contiguous plunger ends of the barrels.

The syringe body further includes a double-plunger assembly having juxtaposed first and second plungers of a common length. Each plunger extends at a proximal end in an end-piece rigidly attached to one of the pistons, and is rigidly attached at a distal end to a thumb-rest common to the plungers.

The syringe body further includes a first mating assembly having diametrically opposed first and second detents extending outwardly from the neck, and opposed first and second locking ribs symmetrically disposed with respect to the neck and rigidly attached, respectively, to the first and second shoulders. Each rib has a plurality of generally planar locking faces generally parallel to and at a common predetermined distance from the neighboring shoulder surface.

The syringe further includes a generally conical mixing tip having an inlet end and a discharge end and a bore therethrough. The bore has a generally cylindrical portion at the inlet end and extends in a conically tapered portion toward the discharge end. The cylindrical bore portion is determined by a circumferential surface adapted to closely receive the body neck. A static mixing element is closely received and wedged within the bore tapered portion. The mixing tip has at the inlet end a second mating assembly having opposed generally planar, arcuate first and second locking tabs of a common predetermined thickness slightly less than the distance between the rib locking faces of the first mating assembly and the neighboring shoulder. Each tab has at least one edge beveled at a common predetermined angle. The tabs are symmetrically disposed with respect to the cylindrical bore portion. The bore circumferential surface includes diametrically opposed first and second detent recesses and first and second ramps which are contiguous at a proximal end, respectively, to the recesses.

The first and second mating assemblies are conjoined when the neck is inserted into the cylindrical bore portion in a relative orientation such that each detent contacts a ramp distal end, thereby determining an engaged configuration. The assemblies interlock when the mixing tip is rotated in a first direction until each detent, traversing the ramp and reaching the ramp proximal end, is received within a recess. Concurrently, each tab is closely received between one of the pluralities of rib locking faces and a shoulder. The mating assemblies are detachable when the mixing tip is rotated in the opposite direction until the neck and cylindrical bore portion are in the engaged configuration.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENT

Figure 1:
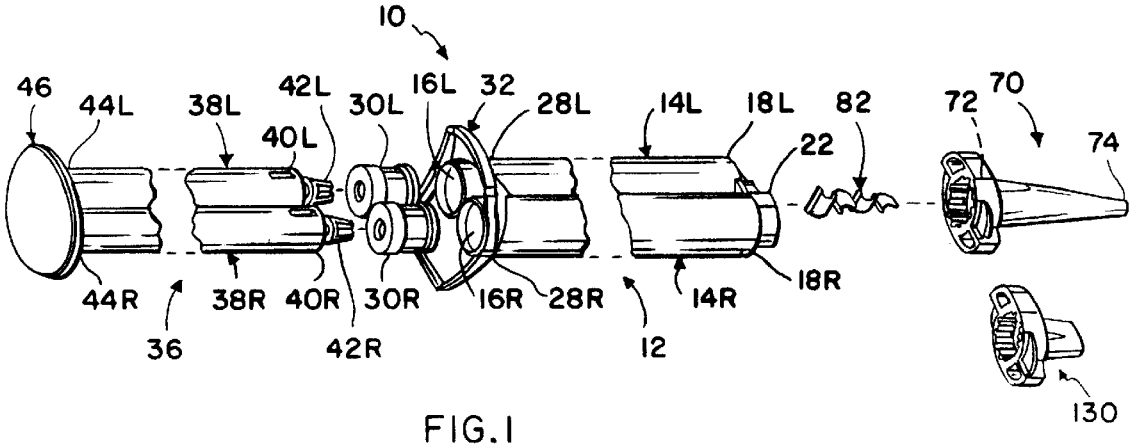
FIG. 1 is an exploded perspective view of a double-barreled syringe according to the invention, including a double-plunger assembly, two pistons, a double-barrel assembly, a static mixing element, a detachable locking mixing tip, and alternatively, a detachable locking cap.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the invention as expressed in the appended claims.

The invention relates to an article of manufacture which is primarily intended for storing and dispensing gels which are components of an admixture and which need to be kept separate until the admixture is formed. However, the invention is not limited to particular types of material to be stored and dispensed, and can be used for storing and dispensing any material that can be placed within a syringe barrel and effectively admixed by a static mixing tip.

Where used herein, the word "attached" means that the two parts referred to (e.g., a locking rib and a shoulder or a plunger end-piece and a piston) are either molded in a single piece, or are glued or force-fitted together. However, other forms of attachment may be suitable, consistent with simplicity of manufacture and reliability of operation. Where used herein, the word "connected" means that the two parts referred to (viz., the two mating assemblies) can be easily separated after being joined together in an interlocking combination.

Figure 2:
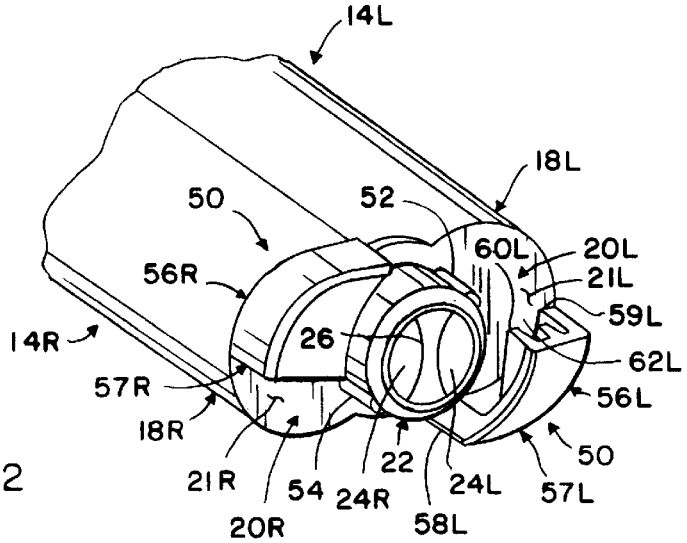
FIG. 2 is a discharge end perspective view of the FIG. 1 double-barrel assembly, including two shoulders, a neck with two outlet passages, and a mating assembly with two diametrically opposed detents and two symmetrically disposed locking ribs for engaging and interlocking with the mixing tip or cap.
Figure 7:
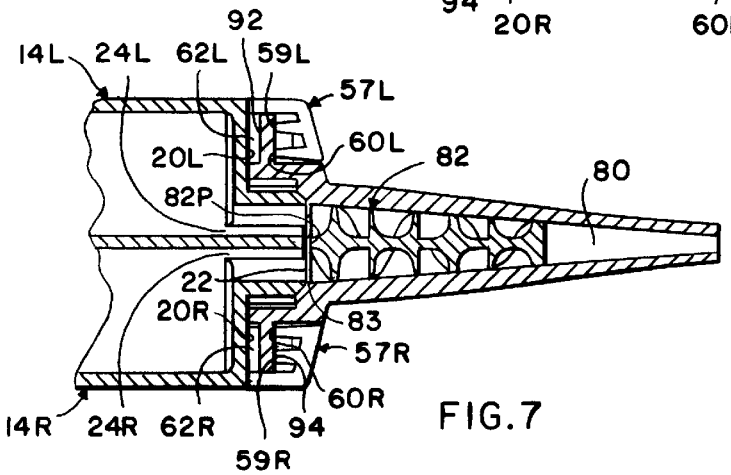
FIG. 7 is a horizontal cross-sectional view of the FIG. 2 discharge end and FIG. 3 inlet end when the mixing tip is locked to the double-barrel assembly.

Referring to FIGS. 1 and 2, a syringe body 10 includes a double-barrel assembly 12 having juxtaposed first and second generally cylindrical barrels 14L, 14R having a common length and a generally cylindrical bore 16L, 16R, respectively, of a common diameter determining storage compartments 15L (not shown), 15R (not shown). Barrels 14L, 14R are bounded at a first (discharge) end 18L, 18R, respectively, by first and second shoulders 20L, 20R, respectively. The shoulders have generally planar surfaces 21L, 21R, respectively, which are coplanar and contiguous. A generally cylindrical neck 22 extends from and is symmetrically disposed between the shoulders. As shown in FIG. 2, neck 22 includes first and second outlet passages 24L, 24R, divided by a partition 26. As best shown in FIG. 7, passages 24L, 24R are in fluid communication, respectively, with barrels 14L, 14R. Barrels 14L, 14R are open at an opposite (plunger) end 28L, 28R, respectively, which closely receives a piston 30L, 30R, respectively. Barrel ends 28L, 28R are circumscribed by and rigidly attached to an arcuately-shaped finger-grip 32.

The syringe body 10 further includes a double-plunger assembly 36 having juxtaposed generally cylindrical first and second plungers 38L, 38R of a common length. Each plunger extends at an end 40L, 40R proximal to a piston in an end-piece 42L, 42R rigidly attached to the piston 30L, 30R, respectively. The plungers are attached at their distal end 44L, 44R to a disc-shaped thumb-rest 46 so that when the thumb-rest is depressed the plungers move forward in tandem, and the attached pistons move in tandem within the barrels.

Still referring to FIG. 2, syringe body 10 further includes a first mating assembly 50 having diametrically opposed first and second detents 52, 54 extending outwardly from neck 22, and opposed first and second locking ribs 56L, 56R symmetrically disposed with respect to neck 22. Ribs 56L, 56R each have a first (stand-off) portion 57L, 57R, respectively, generally parallel to the shoulders 20L, 20R, respectively, and generally orthogonal to a second (bracket) portion 58L, 58R (not shown), respectively, rigidly attached, respectively, to shoulders 20L, 20R. Rib stand-off portions 57L, 57R each have two generally planar locking faces 59L, 60L and 59R (not shown), 60R (not shown), respectively, which are generally parallel to and at a common distance from the neighboring shoulder surface 21L, 21R, respectively, thus determining symmetrical recesses 62L, 62R (not shown), respectively. Preferably, double-barrel assembly 12, including neck 22, and mating assembly 50 are fabricated as a unit from a polymerized alkene such as polypropylene by means of an injection molding process.

Figure 3:
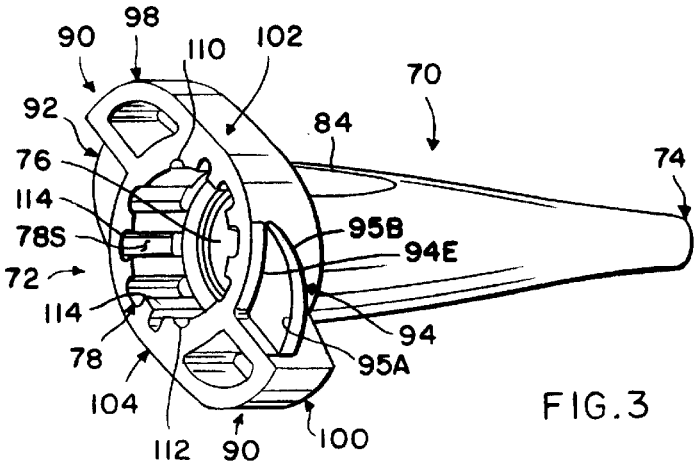
FIG. 3 is an inlet end perspective view of the FIG. 1 mixing tip, including a mating assembly, having two locking tabs, which engages and interlocks with the FIG. 2 mating assembly.
Figure 8:
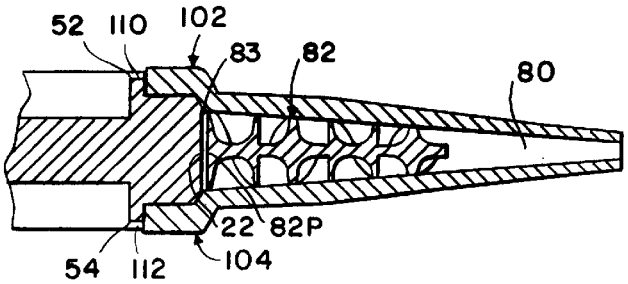
FIG. 8 is a cross-sectional view orthogonal to FIG. 7.

Referring to FIGS. 1 and 3, a generally conical mixing tip 70 includes an inlet end 72 and a discharge end 74 and a bore 76 therethrough. As best shown in FIG. 3, bore 76 has a generally cylindrical portion 78 proximate to inlet end 72 and extends in a conically tapered portion 80 (not shown) toward the discharge end 74. Cylindrical bore portion 78 is determined by a circumferential surface 78S adapted to closely receive the neck 22. As best shown in FIGS. 7 and 8, a static mixing element 82 is closely received and wedged within the tapered bore portion 80. Mixing element 82 is inserted in a random azimuthal orientation within bore portion 80 and so is not disposed in a predetermined orientation with respect to partition 26 and outlet passages 24L, 24R when mixing tip 70 is attached to double-barrel assembly 12. As further shown in FIGS. 7 and 8, when tip 70 and assembly 12 are attached, proximate end 82P of mixing element 82 and neck 22 are separated by a gap 83. Mixing tip 70 further includes an indented surface portion 84 to facilitate a person holding the tip between the thumb and fingers to rotate the tip.

Figure 6A:
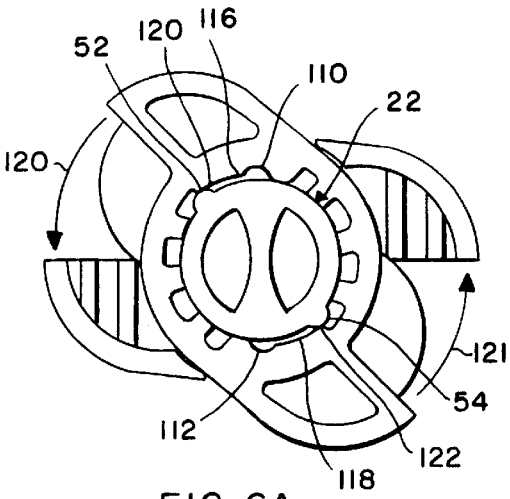
FIG. 6A is a transverse sectional view of the FIGS. 2 and 3 mating assemblies after engagement.
Figure 6B:
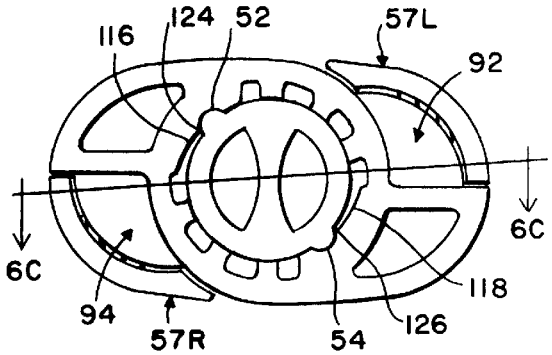
FIG. 6B is a transverse sectional view of the FIGS. 2 and 3 mating assemblies after interlocking.

Still referring to FIG. 3, the inlet end 72 of mixing tip 70 includes a second mating assembly 90 having opposed generally planar arcuately-shaped first and second locking tabs 92, 94 of a common predetermined thickness slightly less than the common width of recesses 62L, 62R. Tabs 92, 94 are symmetrically disposed with respect to cylindrical bore portion 78 and have edges 93A (not shown), 93B (not shown) and 95A, 95B, respectively, which are each beveled at an angle of about 8 degrees. Tabs 92, 94 are rigidly attached, respectively, to structural ribs 98, 100 disposed symmetrically with respect to bore portion 78, and extending in generally oval-shaped collar portions 102, 104, respectively. The two collar portions partially circumscribe inlet end 72 and extend so that tab 92 is rigidly attached at an interior edge 92E (not shown) to collar portion 104, and tab 94 is rigidly attached at an interior edge 94E to collar portion 102. Surface 78S includes diametrically opposed first and second detent recesses 110, 112 and a plurality of corrugations 114. As shown in FIGS. 4A, 4B, 6A and 6B, recesses 110, 112 are each contiguous to first and second ramps 116, 118, respectively, which are generally planar sloping portions of the surface 78S. As shown in FIGS. 4B and 6A, when neck 22 is inserted within bore portion 78, each detent 52, 54 contacts a ramp 116, 118, respectively, at a ramp end 120, 122, respectively, distal to recess 110, 112, respectively. As shown in FIGS. 4C and 6B, when mixing tip 70 is rotated counterclockwise with respect to double-barrel assembly 12, each detent 52, 54 traverses the contacting ramp to the proximal ramp end 124, 126, and is received within the recess. Preferably, mixing tip 70 and associated mating assembly 90 are fabricated as a unit from a polymerized alkene such as polypropylene by means of an injection molding process. As shown in FIG. 1, mixing tip 70 may be replaced by a closure cap 130 having a mating assembly identical to mating assembly 90 so that cap 130 is interchangeable with mixing tip 70.

Figure 4A:
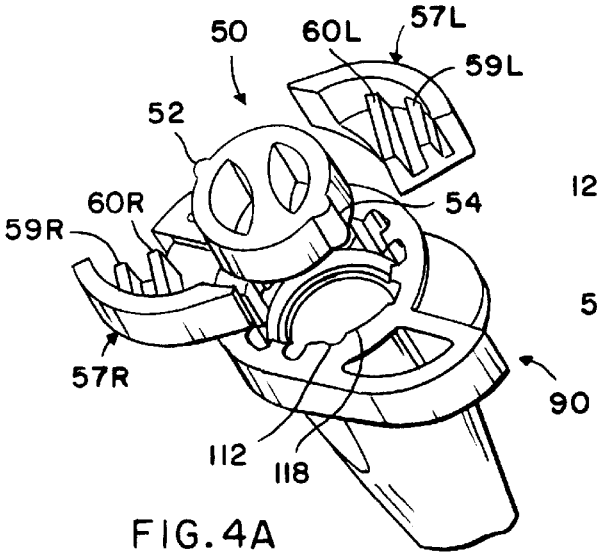
FIG. 4A is a combined exploded perspective and partial sectional view of the FIGS. 2 and 3 mating assemblies before engagement.
Figure 4B:
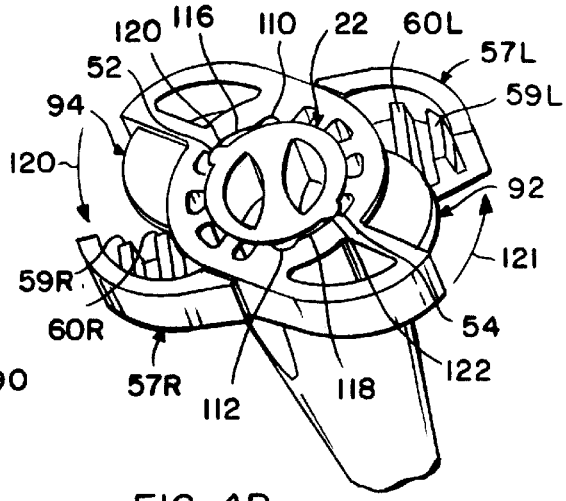
FIG. 4B is a combined perspective and partial sectional view of the FIGS. 2 and 3 mating assemblies after engagement.
Figure 4C:
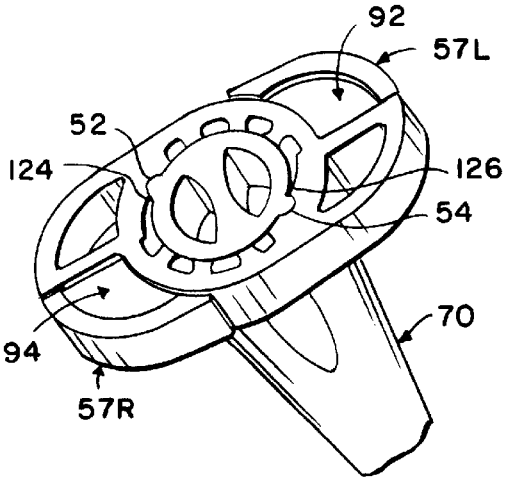
FIG. 4C is a combined perspective and partial sectional view of the FIGS. 2 and 3 mating assemblies after interlocking.
Figure 5A:
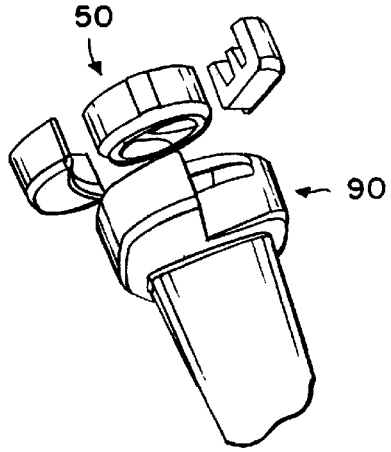
FIG. 5A is a perspective view of the FIGS. 2 and 3 mating assemblies before engagement.
Figure 5B:
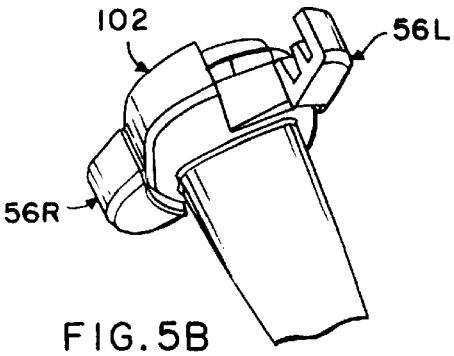
FIG. 5B is a perspective view of the FIGS. 2 and 3 mating assemblies after engagement.
Figure 5C:
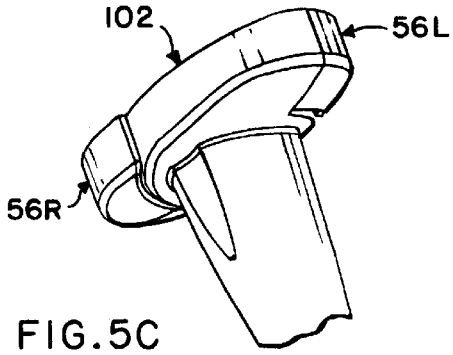
FIG. 5C is a perspective view of the FIGS. 2 and 3 mating assemblies after interlocking.
Figure 6C:
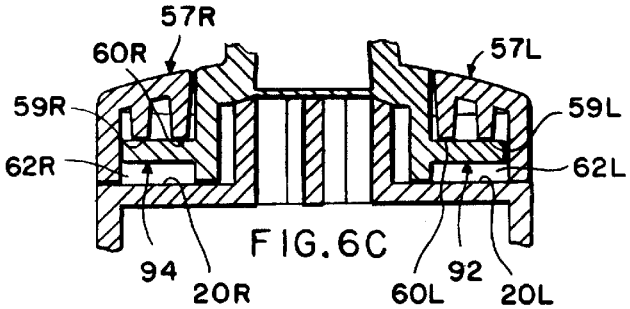
FIG. 6C is a cross-sectional view of the FIG. 6B mating assemblies taken along offset line 6C—6C, showing each locking tab disposed within a recess determined by a FIG. 2 shoulder and locking rib.

FIGS. 4A and 5A show the proper relative orientation between mating assemblies 50 and 90 so that neck 22 can be inserted into bore portion 78. FIGS. 4B and 6A show the mating assemblies engaged but not yet interlocked. FIG. 5B shows the disposition in the engaged position of collar portion 102 with respect to locking ribs 56L, 56R of mating assembly 50. In FIGS. 4B and 6A, arrows 120, 121 show the (counterclockwise) rotational direction for interlocking. FIGS. 4A and 4B show rib stand-off portions 57L and 57R with respective locking faces 59L, 60L and 59R, 60R. FIGS. 4B and 6A further show the respective disposition of locking tabs 92, 94 of mating assembly 90 and rib stand-off portions 57L, 57R of mating assembly 50 before interlocking. FIGS. 4C and 6B show the respective disposition of locking tabs 92, 94 and rib stand-off portions 57L, 57R after interlocking when tabs 92, 94 have been closely received within recesses 62L, 62R, respectively, and detents 52, 54 received within recesses 110, 112, respectively. Tab insertion and removal are facilitated by beveled edges 93A, 93B of tab 92 and beveled edges 95A, 95B of tab 94. FIG. 5C shows the disposition in the interlocked position of collar portion 102 with respect to locking ribs 56L, 56R. FIGS. 6C and 7 show locking tabs 92, 94 received within recesses 62L, 62R, respectively, determined, respectively, by shoulders 20L, 20R and rib stand-off portions 57L, 57R with locking faces 59L, 60L and 59R, 60R. As best shown in FIG. 7, locking tabs 92, 94, when received within recesses 62L, 62R, contact locking faces 59L, 60L and 59R, 60R, respectively. FIG. 8 shows detents 52, 54 in relation, respectively, to recesses 110, 112 and to collar portions 102, 104.

After dispensing a desired amount of admixture, a user typically would detach the mixing tip 70 from the double-barrel assembly 12 by rotating the tip clockwise until detents 52, 54 reach ramp distal ends 120, 122, at which position locking tabs 92, 94 are disengaged from recesses 62L, 62R, and then pulling apart the mixing tip and double-barrel assembly. The corrugation in surface 78S contiguous to each ramp distal end acts as a stop for the detent, thus preventing over-rotation and ensuring that mating assemblies 50 and 90 return to the engaged position. The closure cap 130 may then be connected to the syringe body 10 by using the same engagement and locking procedure as used for the tip.

Preferably, the double-barrel assembly 12 and attached mating assembly 50, double-plunger assembly 36, mixing tip 70 and attached mating assembly 90, and closure cap 130 are fabricated from a polymerized alkene such as polypropylene. Preferably, the length between thumb-rest 46 and discharge end 74 of mixing tip 70 is about 6.75 inches when plungers 38L, 38R are fully retracted. Preferably, the combined width of juxtaposed barrels 14L, 14R is about 0.65 inch.

What is claimed is:

1. A syringe for dispensing two viscous materials as an admixture, comprising:

first and second barrels each bounded at a discharge end by first and second shoulders, respectively, each shoulder having a generally planar surface, the surfaces coplanar and contiguous, a generally cylindrical neck extending from and symmetrically disposed between the shoulders, the neck including first and second outlet passages in fluid communication, respectively, with the first and second barrels;

a first mating assembly having opposed first and second detents extending outwardly from the neck, and opposed first and second locking ribs symmetrically disposed with respect to said neck and rigidly attached, respectively, to said first and second shoulders, each rib having a plurality of generally planar locking faces generally parallel to and at a common distance from said shoulder surface;

a mixing tip comprising, at an inlet end having a generally cylindrical bore determined by a circumferential surface adapted to closely receive said neck, a second mating assembly having opposed generally planar first and second locking tabs symmetrically disposed with respect to said bore, said surface having opposed first and second detent recesses and first and second ramps contiguous at a proximal end, respectively, to said recesses, the mating assemblies conjoining when the neck is inserted into the bore in a relative orientation such that each detent contacts a ramp distal end, thereby determining an engaged configuration, the mating assemblies interlocking when the mixing tip is rotated in a first direction until each detent, traversing the ramp and reaching the ramp proximal end, is received within a recess, and each tab is closely received between one of said pluralities of rib locking faces and a shoulder, the mating assemblies detachable when the mixing tip is rotated in the opposite direction until the neck and bore are in said engaged configuration.

2. A syringe for dispensing two viscous materials as an admixture, comprising a body and a mixing tip:

the body comprising a double-barrel assembly having juxtaposed first and second barrels having a common length and a generally cylindrical bore of a common diameter, each barrel bounded at a discharge end by first and second shoulders, respectively, each shoulder having a generally planar surface, the surfaces coplanar and contiguous, a generally cylindrical neck extending from and symmetrically disposed between the shoulders, the neck including first and second outlet passages in fluid communication, respectively, with the first and second barrels, each barrel at an opposite end circumscribed by a common finger-grip closely receiving within said bore a piston;

the body further comprising a double-plunger assembly having juxtaposed first and second plungers of a common length, each plunger extending at a proximal end in an end-piece rigidly attached to one of said pistons, and at a distal end rigidly attached to a common thumb-rest;

the body further comprising a first mating assembly having diametrically opposed first and second detents extending outwardly from the neck, and opposed first and second locking ribs symmetrically disposed with respect to said neck and rigidly attached, respectively, to said first and second shoulders, each rib having a plurality of generally planar locking faces generally parallel to and at a common predetermined distance from said shoulder surface;

the mixing tip having an inlet end and a discharge end and a bore therethrough, the bore having a generally cylindrical portion at the inlet end and extending in a conically tapered portion toward the discharge end, said cylindrical portion determined by a circumferential surface adapted to closely receive said neck, a static mixing element being closely received and wedged within the tapered portion;

the mixing tip having at the inlet end a second mating assembly having opposed generally planar, arcuate first and second locking tabs of a common predetermined thickness less than said first mating assembly predetermined distance, each tab having at least one edge beveled at a common predetermined angle, the tabs symmetrically disposed with respect to said cylindrical bore portion, said circumferential surface having diametrically opposed first and second detent recesses and first and second ramps contiguous at a proximal end, respectively, to said recesses, the first and second mating assemblies conjoining when the neck is inserted into the cylindrical bore portion in a relative orientation such that each detent contacts a ramp distal end, thereby determining an engaged configuration, the mating assemblies interlocking when the mixing tip is rotated in a first direction until each detent, traversing the ramp and reaching the ramp proximal end, is received within a recess, and each tab is closely received between one of said pluralities of rib locking faces and a shoulder, the mating assemblies detachable when the mixing tip is rotated in the opposite direction until the neck and cylindrical bore portion are in said engaged configuration.

3. The syringe of claim 2, wherein the length between the thumb-rest and the mixing tip discharge end is about 6.75 inches when the plungers are fully retracted, and the combined width of the juxtaposed barrels is about 0.65 inch.

4. The syringe of claim 3, wherein said common bevel angle is about 8 degrees.

* * * * *